United States Patent [19]

Houghton

[11] 4,174,744

[45] Nov. 20, 1979

[54] CONTAINER CLOSURE WITH COMPARTMENT

[76] Inventor: James R. Houghton, 34485 Kirkpatrick Rd., R.R. 3, Mission, British Columbia, Canada, V2V4J1

[21] Appl. No.: 899,978

[22] Filed: Apr. 25, 1978

[51] Int. Cl.[2] ..... B65B 3/06

[52] U.S. Cl. ..... 141/98; 141/364

[58] Field of Search ..... 141/364, 363, 365, 366, 141/98; 83/1 R

[56] References Cited

U.S. PATENT DOCUMENTS 3,863,690 2/1975 Dean ..... 141/364

*Primary Examiner*—Houston S. Bell, Jr.

*Attorney, Agent, or Firm*—Howard I. Podell

[57] ABSTRACT

A container closure for a container having an opening and thread means formed thereon; the closure having an externally threaded skirt portion mating with the thread means and depending from a wide-mouthed flared body portion forming a compartment for a substance to be added to the container. The flared body has a threaded upper portion above its mouth closed by a screw cap and an open bottom. In one version of the invention, a cup is supported by its rim between the flanged top of the body portion and the bottom of the screw cap. In another embodiment, a spring-biased valve liftable by means of knob at the upper end of a stem extending through the screw normally closes the bottom of the compartment until its contents are required in the container. The present closure is particularly useful as a reserve fuel supply for a power saw. The wide mouth of the closure serves also as a funnel for pouring fuel into the container or tank.

7 Claims, 3 Drawing Figures

CONTAINER CLOSURE WITH COMPARTMENT

FIELD OF THE INVENTION

This invention relates generally to a container closure having a compartment therein and so shaped as to serve as a funnel for the container.

DESCRIPTION OF THE PRIOR ART

The prior art, as exemplified by U.S. Pat. Nos. 1,409,387; 3,326,400; 2,524,364; 2,211,326; 2,105,487 and 1,429,507 is generally illustrative of the pertinent art but the aforementioned patents are non-applicable to the present invention. While the prior art expedients are generally acceptable for their intended purposes only, they have not proven entirely satisfactory in that they are either complex and expensive to manufacture, or bulky and inconvenient to use, or require unusual skill and/or dexterity to operate. As a result of the shortcomings of the prior art, typified by the above, there has developed a substantial need for improvement in this field.

The principal object of this invention is to provide an article of this character which combines simplicity, strength and durability in a high degree, together with inexpensiveness of construction owing to a minimum of parts so as to encourage widespread use thereof.

Other objects of this invention will in part be obvious and in part hereinafter pointed out.

The invention accordingly consists in the features of construction, combinations of elements, and arrangement of parts which will be exemplified in the construction hereinafter described, and of which the scope of application will be indicated in the following claims.

SUMMARY OF THE INVENTION

This invention resides in a container closure for a container having an opening and thread means formed thereon; the closure having an externally threaded skirt portion mating with the thread means and depending from a wide-mouthed flared body portion forming a compartment for a substance to be added to the container. The flared body has a threaded upper portion above its mouth closed by a screw cap and an open bottom. In one version of the invention, a cup is supported by its rim between the flanged top of the body portion and the bottom of the screw cap. In another embodiment, a spring-biased valve liftably by means of a knob at the upper end of a stem extending through the screw normally closes the bottom of the compartment until its contents are required in the container. The present closure is particularly useful as a reserve fuel supply for a power saw. The wide mouth of the closure serves also as a funnel for pouring fuel into the container or tank.

BRIEF DESCRIPTION OF THE DRAWING

In the accompanying drawing, in which are shown two of the various possible illustrative embodiments of this invention, wherein like reference character identify the same or like parts.

DESCRIPTION OF THE PREFERRED EMBODIMENTS

Figure 1:
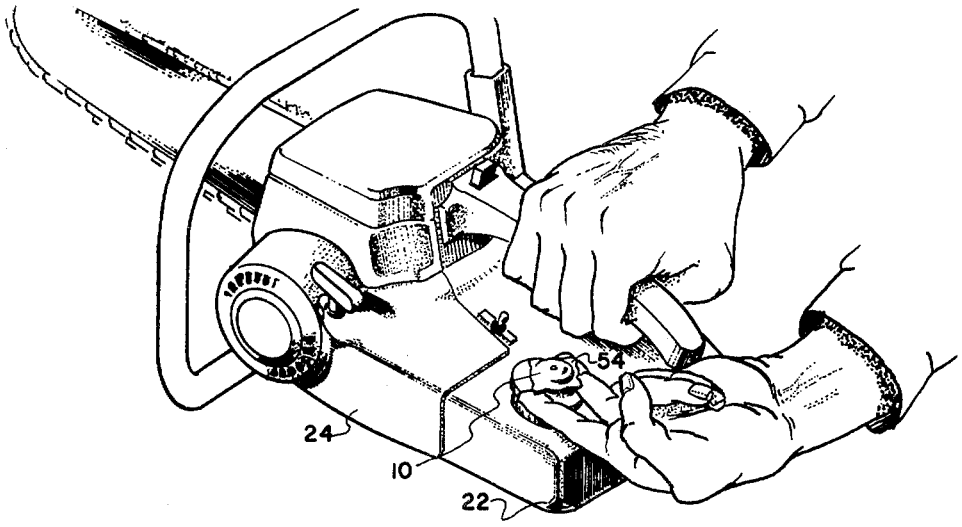
FIG. 1 is a view in perspective showing a power saw with a fuel tank equipped with a closure according to this invention.

With reference to the drawing, there is shown and illustrated a container closure constructed in accordance with the principles of the invention and designated generally by reference character 10. The illustrated tangible embodiment of the invention includes a flared wide-mouthed body 12 of metal or plastic integral with an externally threaded depending skirt 14 formed with bottom opening 16. Closure 10 is intended to be screwed on the externally threaded mouth 18 of a container 20 which can be the fuel tank 22 of a power saw 24, as shown in FIG. 1, or that of another internal combustion engine.

Figure 2:
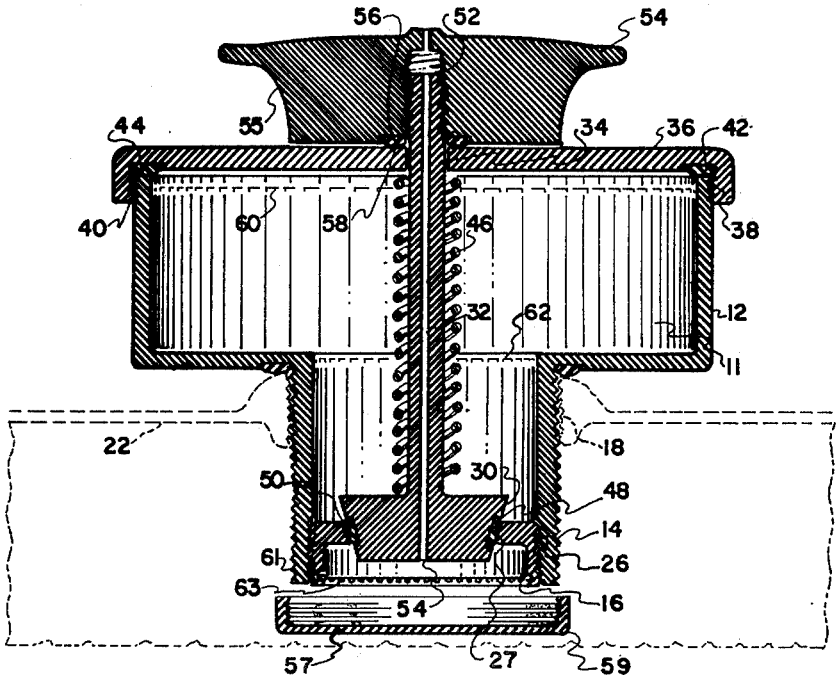
FIG. 2 is a sectional view of one type of closure having a spring urged valve for dispensing the contents of its compartment.

Referring now to FIG. 2, the bottom of skirt 14 is internally threaded to receive inverted dish-shaped bracket 26 which has a central opening 28 therein whose sides serve as a seat for valve 30 integral with valve stem 32 whose upper end is slidably mounted in central opening 34 of screw cap 36. Cap 36 has an internally threaded peripheral flange 38 mating with the externally threaded upper part 40 of body 12. A circular recess 42 is provided in the lower surface of cap 36 above the top of body 12 to accomodate washer 44.

An expansion spring 46 is wound about valve stem 32 between the bottom of cap 36 and valve 30 so as to normally bias valve 30 towards seat 27. A circular recess 48 is provided in valve 30 to receive elastic sealing washer 50 which contacts the annular surface of seat 27. The upper end of stem 32 is threaded to engage threaded cavity 52 in knob 54. Cavity 52 is open at its upper end and communicates with central bore 54 in stem 32 to provide venting means. Knob 54 has an annular recess 56 in its center around stem 32 in which is housed sealing washer 58. As shown in FIGS. 1 and 2, knob 54 has a flared periphery wide enough to allow pulling up by a user wearing gloves and has undercut recess 55 to facilitate same.

An accessory bottom cap 57 has internal threads 59 for securing on mating threads 61 on the outside of skirt 14. Cap 57 is placed on the bottom of closure 10 when same is removed from tank 22 and used for measuring fuel oil into another container. Cap 57 is then removed when closure 10 is put back on tank 22.

A fuel filtering screen 63 is friction-fitted in an annular recess in the bottom of bracket 26.

To use closure 10, remove cap 36 from the reserve tank housing container 12. When the cap 36 is removed, the fuel release valve unit is left on.

Fill the main tank 22 and reserve tank housing compartment 11 with fuel to the top. Replace the reserve tank cap 36 back on to the reserve tank housing compartment 11. In so doing, the reserve fuel supply is safely secured above the main tank 22. When reserve fuel supply is needed, simply pull knob 54 on the fuel release valve unit up. In so doing, the valve 48 is pulled out of the hole in bottom 27 and fuel runs down into the main tank 22.

For measuring fuel oix mix, proceed as follows: The reserve tank housing container 12 has two lines 60, 62 engraved on its inner surface. The bottom line 62 represents the right amount of oil to be poured into the cup for one tank of fuel. The second line 60 represents the right amount of oil to be poured into a one gallon container. As power saws usually have a tank that holds less than a gallon of fuel the bottom line will be used. Casual power saw users are more apt to use this measure, as they do not always require a gallon of fuel. Tree fallers or loggers using saws all day would make use of the top line 60 (one gallon indicator). By removing the knob 54 from the fuel release valve unit, the valve is left sealed in the hole at bottom when the closure 36 is removed. One can then fill the tank housing container with oil and then empty it into a one gallon container which is usually present at a worksite. This valve plug 30 is pulled out when one wishes to pour the oil into the saw tank. To reuse cap as an emergency fuel supply reserve, screw all the parts together.

This embodiment of the invention is mainly for use on power saws used by professional loggers. They probably would not use the cap as an oil measure device except in emergencies. Its primary function is to ensure a reserve fuel supply immediately available when needed simply by pulling the valve stem 32. The present embodiment can also be used on ordinary gas cans.

Figure 3:
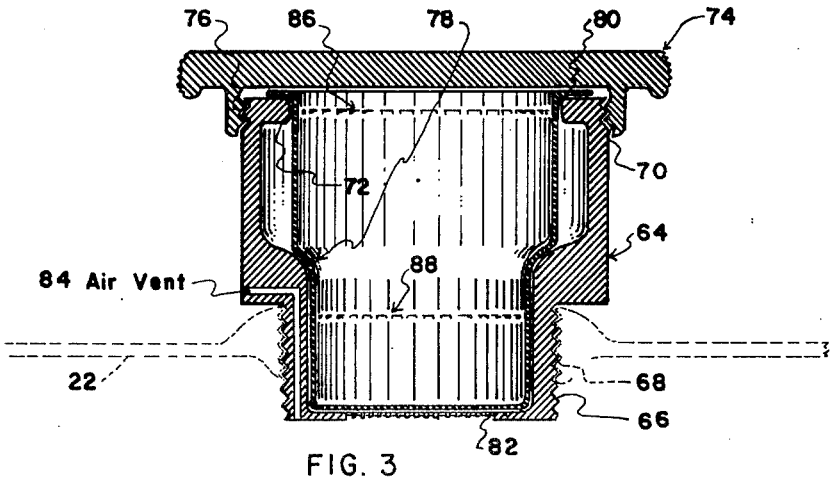
FIG. 3 is a sectional view of another embodiment wherein the closure's compartment contains a cup for holding a material in reserve for later use.

FIG. 3 shows another embodiment of the invention which can be used on other containers besides fuel tanks. This closure can be put on, for example, coffee jars to contain sugar or on medicine bottles to hold a second drug to be used concurrently with one stored in the bottle.

The closure of FIG. 3 includes a cylindrical, dished-shaped body 64 having a depending skirt portion 66 which is externally threaded to screw in mouth 68 of container 22 which in this example also is a fuel tank. The upper portion of body 64 is externally threaded at 70 and its top is integral with inner peripheral shoulder 72. An outwardly flared cap 74 has a depending inwardly threaded flange 76 which screws on body 64. A combination oil mix measuring and fuel reserve cup 78 has a horizontally projecting peripheral rim 80 which rests on shoulder 72 and is rigidly held thereon by the undersurface of cap 74.

The bottom of skirt 66 is fitted with filter 82 and a vent hole 84 is provided therein.

To use, remove reserve tank cap 74 from the reserve tank housing container 64 then, take out the combination oil mix measuring cup and reserve tank 78 from the reserve tank housing container 64 and set aside.

Then fill the main tank 22 to the top with fuel and replace cup 78 back into the reserve tank housing container 64. One can then also fill the cup 78 with gas from the gas can; replace the reserve tank cap 74 onto the reserve tank housing container 64 and screw on. An emergency or reserve fuel supply is thus safely secured above the main tank.

For measuring fuel oil mix proceed as follows: The cup 78 has two lines 86, 88 engraved on its inside surface. The bottom line 88 represents the right amount of oil to be poured in the cup for one tank of fuel. The second line 86 represents the right amount of oil to be poured into a one gallon container. As power saws usuallly have a tank that holds less than a gallon of fuel the bottom line 88 will be used. Casual power saw users are more apt to use this measure, as they do not always require a whole gallon of fuel. People using saws all day would make use of the top line 86 (one gallon indicator). They will take the cup 78 out of the reserve tank housing container 64, fill it with oil, and empty into a one gallon container, which they usually have at their worksite. For motors with larger gas tanks such as some boat motors, the cup 78 can be used to measure the required amount of oil to be mixed with the gas.

The present invention is believed to accomplish among others all of the objects and advantages herein set forth.

Without further analyses, the foregoing will so fully reveal the gist of this invention that those skilled in the art can be applying current knowledge thereto readily adapt it for various applications without omitting certain features which can constitute essential characteristics of the generic or specific aspects of this invention. Therefore, a more lengthy description is deemed unnecessary.

It is intended that various changes may be made in this invention in the practical development thereof, if desired. Such changes are comprehended within the meaning and range of equivalency of the following claims. The invention, therefore, is not to be restricted except as is necessitated by the prior art.

Having thus described the invention, what is claimed as new and to be secured by Letters Patent is:

1. A container enclosure adaptable for direct detachable coupling to the inlet of a liquid fuel tank, which enclosure provides for subsequent discharge into said tank when so desired by user, together with means to serve as funnel for the purpose of pouring liquid fuel directly into said fuel tank, which enclosure is fitted with indicia means for measuring a fixed volume of lubricant that may be subsequently added into said tank, with said enclosure formed with a bottom outlet opening, said outlet opening of a size and shape to attach about the mouth of the inlet of a liquid fuel tank such as a tank of an internal combustion engine powered saw, and with said enclosure formed with a top inlet opening of a substantially greater area than the area of the bottom outlet opening with said container formed with a hollow interior chamber that communicates with said outlet opening and said inlet opening so that the container serves as a funnel for pouring of liquid fuel into said inlet opening and out of said outlet opening into the mouth of an attached liquid fuel tank, together with removable means in said interior chamber to block communication between the interior of the chamber and the bottom inlet opening so that liquid stored in said interior chamber serves as a reserve supply of fuel to the attached tank when the said communication is blocked by said means, together with a cover detachably mounted to the enclosure which is shaped to close the top inlet opening.

2. The combination as recited in claim 1 in which the bottom outlet opening of the enclosure is formed in a section that is shaped to fit inside of the mouth of an attached liquid fuel tank in the attached mode of the closure to a said liquid fuel tank.

3. The invention as recited in claim 1, in which said outlet opening and said inlet opening are substantially located along a common axis, with the removable means in the interior chamber formed as a cup shape with a closed bottom wall, which cup fits within the interior chamber of the enclosure, said cup extending substantially from the bottom outlet opening to the top inlet opening, with the interior of said cup serving as the space for storage of a reserve supply of liquid fuel in said enclosure, and with the bottom wall of said cup serving as the means in the interior chamber to block communication between the interior of the chamber and the bottom opening of the enclosure.

4. The invention as recited in claim 3 in which the interior of the cup is provided with two sets of indicia means to indicate at two separate level locations, the upper surface of a liquid in said cup when the cup is filled in the erect position of the cup so that the upper surface of such liquid lies adjacent either set of indicia means, with one set of indicia means indicating a suggested volume of liquid oil that is to be mixed with an otherwise full tank of fuel of an attachable fuel tank of an engine powered saw, and the other set of indicia means indicating a suggested volume of liquid oil that is to be mixed with a particular volume of fuel in a portable fuel container.

5. The invention as recited in claim 3 in which the container enclosure is formed with a passageway in a wall of the enclosure which extends from an external side surface of the enclosure to a bottom surface of the enclosure so as to provide a vent from the interior of a fuel tank when the enclosure is coupled to the inlet of such tank.

6. The invention as recited in claim 1 in which the means in the interior chamber to block communication is a valve that fits into a valve seat, with said valve fixed to a valve stem that slidably extends through the detachable cover of the enclosure, and with spring means mounted about said valve stem to bias the said valve against the valve seat which is formed as a circular flange in the enclosure about the bottom outlet opening of the enclosure.

7. The combination as recited in claim 5 in which the interior wall of the interior chamber is provided with two sets of indicia means to indicate at two separate level locations, the upper surface of a liquid in said chamber when the chamber is filled in the erect position of the enclosure so that the upper surface of such liquid lies adjacent either set of indicia means, with one set of indicia means indicating a suggested volume of liquid oil that is to be mixed with an otherwise full tank of fuel of an attachable fuel tank of an engine powered saw, and the other set of indicia means indicating a suggested volume of liquid oil that is to be mixed with a particular volume of fuel in a portable fuel container.

* * * * *